US005503067A

United States Patent [19]

Jaffa

[11] Patent Number: 5,503,067

[45] **Date of Patent: *Apr. 2, 1996**

[54] SQUEEGEE FOR PRINTING APPARUATS

[75] Inventor: David Jaffa, Franklin Lakes, N.J.

[73] Assignee: Precision Screen Machines, Inc., Glen Ellyn, Ill.

[ * ] Notice: The portion of the term of this patent shall not extend beyond the expiration date of Pat. No. 5,392,705.

[21] Appl. No.: 346,614

[22] Filed: Nov. 30, 1994

Related U.S. Application Data

[63] Continuation of Ser. No. 219,762, Mar. 24, 1994, Pat. No. 5,392,705.

[51] Int. Cl.[6] ..... B41F 15/46

[52] U.S. Cl. ..... 101/123; 101/114; 101/120; 101/129

[58] Field of Search ..... 101/114, 120, 101/123, 124, 129; 118/413

[56] References Cited

U.S. PATENT DOCUMENTS

| | | | |
|---|---|---|---|
| 4,216,716 | 8/1980 | Zimmer | 101/120 |
| 5,027,703 | 7/1991 | Hancy | 101/123 |
| 5,165,339 | 11/1992 | Hoffman et al. | 101/123 |
| 5,285,724 | 2/1994 | Kobayasi et al. | 101/120 |

FOREIGN PATENT DOCUMENTS

| | | | |
|---|---|---|---|
| 159416 | 3/1983 | Germany | 101/124 |
| 59081 | 4/1983 | Japan | 101/123 |
| 185651 | 10/1984 | Japan | 101/123 |
| 86548 | 4/1991 | Japan | 101/123 |
| 77393 | 3/1993 | Japan | 101/120 |

*Primary Examiner*—Stephen Funk

*Attorney, Agent, or Firm*—Hopgood, Calimafde, Kalil & Judlowe

[57] ABSTRACT

This invention relates to a flood bar and squeegee for printing apparatus. In accordance with one aspect of the present invention, the flood bar or squeegee comprises an elongated member having an ink engaging face. A plurality of spaced apart fins are arranged across the face. The fins are generally parallel to one another and each end of the member is bent inwardly so as to inhibit the flow of ink to the sides of the screen.

2 Claims, 7 Drawing Sheets

SQUEEGEE FOR PRINTING APPARUATS

This application is a continuation of U.S. application Ser. No. 08/219,762, filed Mar. 24, 1994, which issued as U.S. Pat. No. 5,392,705 on Feb. 28, 1995.

BACKGROUND OF THE INVENTION

The present invention relates generally to printing apparatus and more particularly to a device which both improves the quality of printed images and lovers printing costs.

The printing of images on articles, and particularly clothing (such as T-shirts and the like), is commonly accomplished by screen printing machines. Generally, these machines are provided with a print squeegee which is stroked across the surface of the screen so as to force printing ink through the screen, thereby effecting printing. Screen printing apparatus of this general configuration are disclosed, for example, in U.S. Pat. Nos. 3,795,189 and 4,939,991, the disclosures of which are hereby incorporated by reference.

In operation, the clothing or other material to receive the printed image are placed on pallets so that the surface to be printed upon is exposed. The pallets are then indexed to each in a series of printing stations. At each station, a printing head lovers the printing screen to a position slightly above the print surface. Upon stroking a flood bar and squeegee assembly back and forth across the screen, an image is printed on the article surface. During a first step of printing, the flood bar is lowered to a position in contact with the screen and passed over the screen, spreading printing ink over the screen surface. Next, the flood bar is raised and the squeegee is lowered into contact with the screen. The squeegee is passed back over the screen, momentarily forcing the screen into contact with the printing surface while forcing ink through the screen to effect printing.

As the flood bar is stroked across the screen, a rave of ink is formed which the flood bar pushes over the screen surface. During this operation, the ink has a tendency to flow toward the edges of the flood bar. After a few printing strokes, most of the ink accumulates on the sides of the screen, outside the path of the flood bar and squeegee. To reuse the accumulated ink, it is manually scraped toward the center of the screen on a regular basis.

Although conventional flood bars have been found effective in spreading ink, airborne lint and other debris constantly mix with the accumulated ink, eventually clogging the screen mesh and causing misprints. It was then necessary to halt printing operations to clean the screen. While clogging has been decreased (and production maintained) by periodically adding new ink to the screen surface, large amounts of ink accumulated. This was costly not only in wasting ink, but also delaying clean up.

To help contain the ink, the ends of the flood bars have been bent inwardly, e.g., at a 45° angle. Other flood bars have been formed in a concave shape. Either way, conventional flood bars have met limited success in controlling the flow of ink. Moreover, the concave designs have been found to substantially increase the spacing between the squeegee and the flood bar which is undesirable.

SUMMARY OF THE INVENTION

In accordance with one aspect of the present invention, there is provided a flood bar for printing apparatus. The bar comprises an elongated member having an ink engaging face. A plurality of spaced apart fins are arranged across the face. The fins are generally parallel to one another and each end of the member is bent inwardly so as to inhibit the flow of ink to the sides of the screen.

The present invention is directed to a flood bar for printing apparatus, which comprises:

a member having an ink engaging face;

a plurality of spaced apart fins arranged across the face, the fins being generally parallel to one another and each end of the member being bent inwardly so as to inhibit the flow of ink to the sides of the screen.

The present invention is also directed to a method for controlling the flow of ink over a printing screen, which comprises the steps of spreading a plurality of ink waves over a printing screen, the waves being generated by spaced apart fins arranged across the face of a flood bar member, the fins being generally parallel to one another and each end of the member being bent inwardly so as to inhibit the flow of ink to the sides of the screen.

The present invention is further directed to a squeegee for printing apparatus, which comprises an elongated member having an ink engaging face; and a plurality of spaced apart fins arranged across the face, the fins being generally parallel to one another so as to inhibit the flow of ink to the sides of the screen.

The present invention is additionally directed to a method of controlling the flow of ink over a printing screen, which comprises the steps of spreading a plurality of ink waves over a printing screen, the waves being generated by spaced apart fins arranged across the face of a squeegee member, the fins being generally parallel to one another so as to inhibit the flow of ink to the sides of the screen.

Accordingly, it is an object of the present invention to increase production and improve the quality of printed images upon each of successive printing operations.

Another object of the present invention is to substantially consume the printing ink in a relatively short time with minimal labor.

Yet another object of the present invention is to limit mixing between different colored printing inks when used simultaneously during multicolor printing operations.

Still another object of the present invention is to lower printing costs.

The present invention will now be further described by reference to the following drawings which are not to be deemed limitative in any manner thereof.

BRIEF DESCRIPTION OF THE DRAWINGS

The same numerals are used throughout the various figures of the drawings to designate similar parts.

Figure 1:
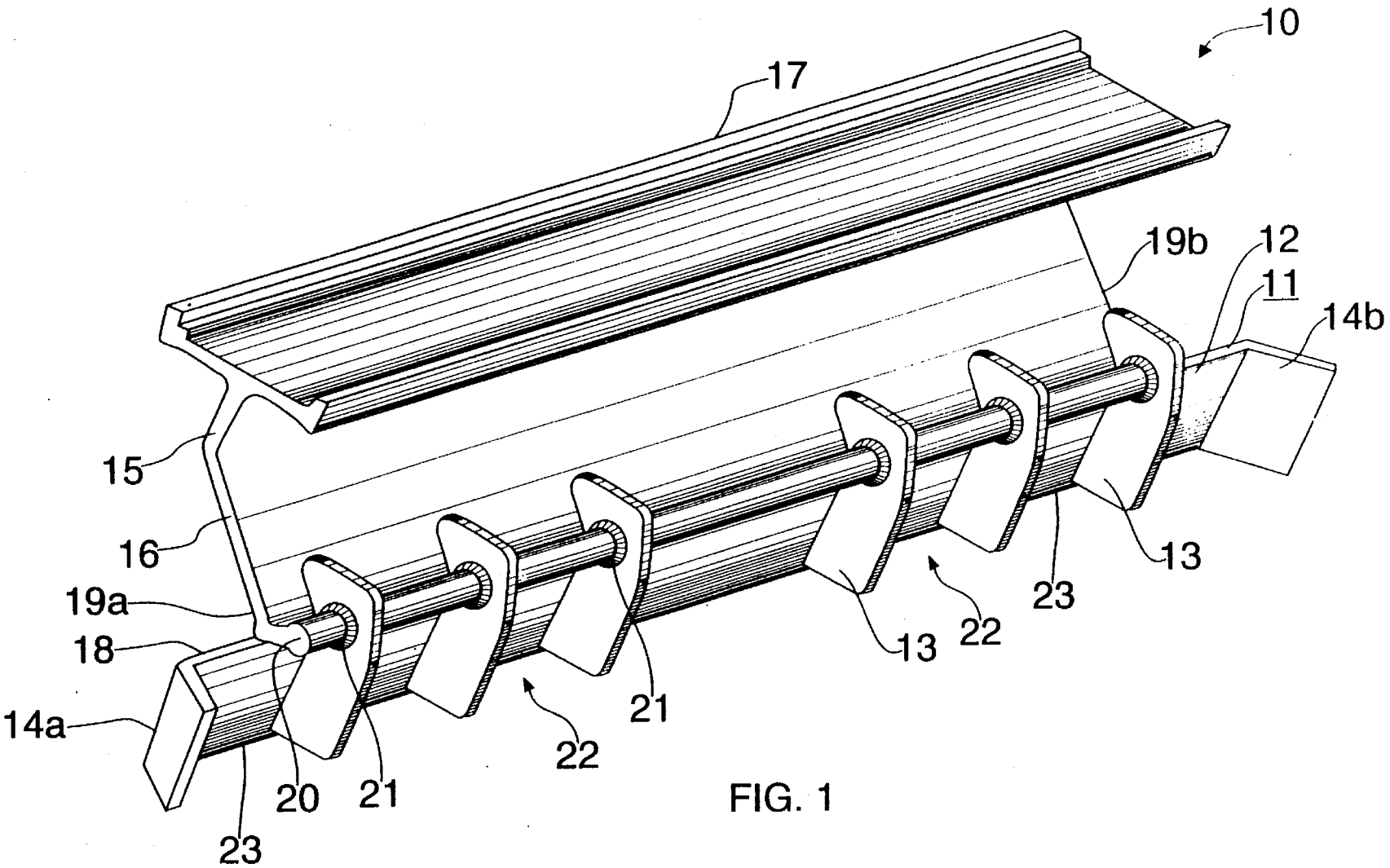
FIG. 1 is a perspective view of a flood bar, in accordance with one aspect of the present invention.
Figure 2:
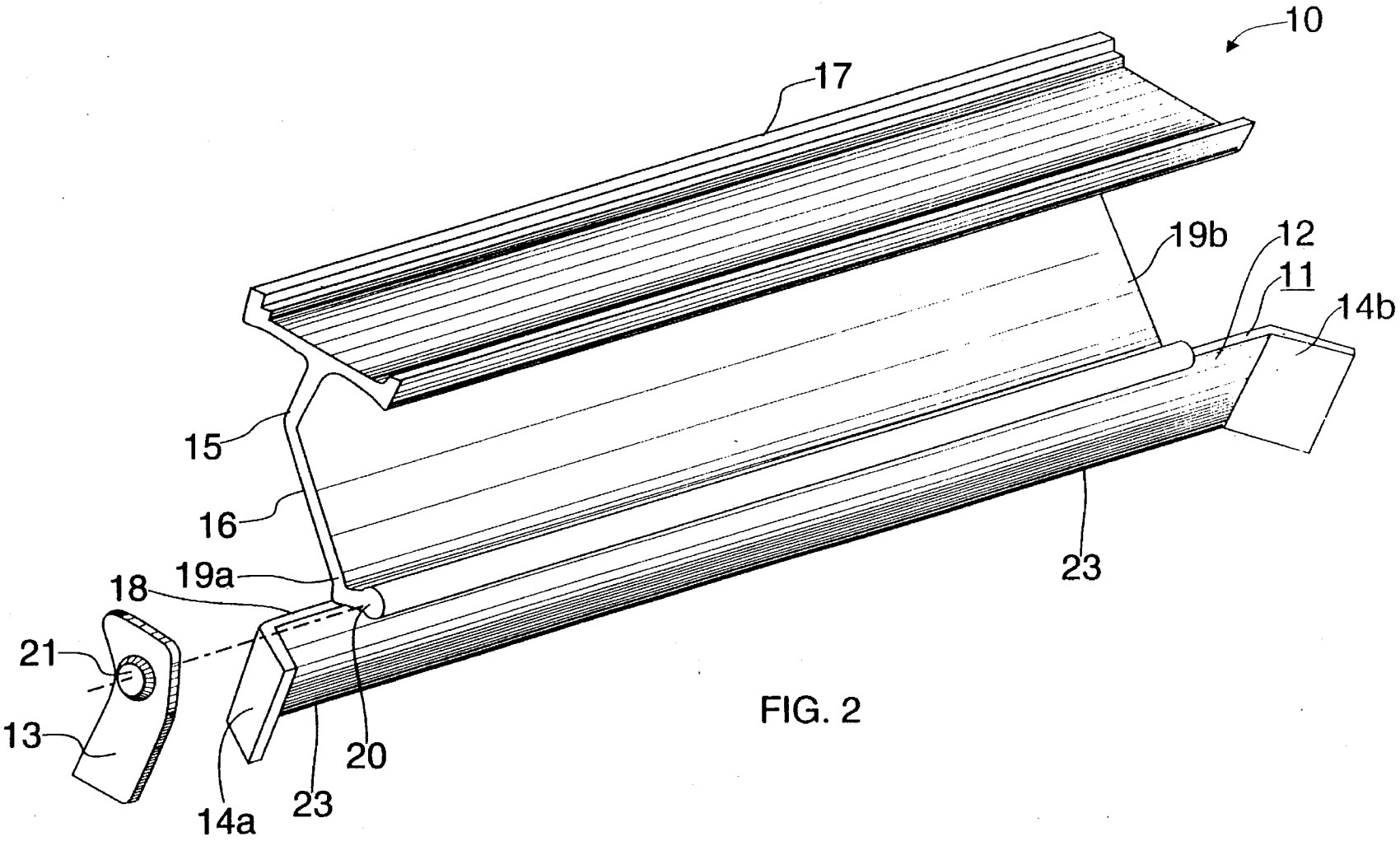
FIG. 2 is a perspective view of the flood bar of FIG. 1 without fins.
Figure 3:
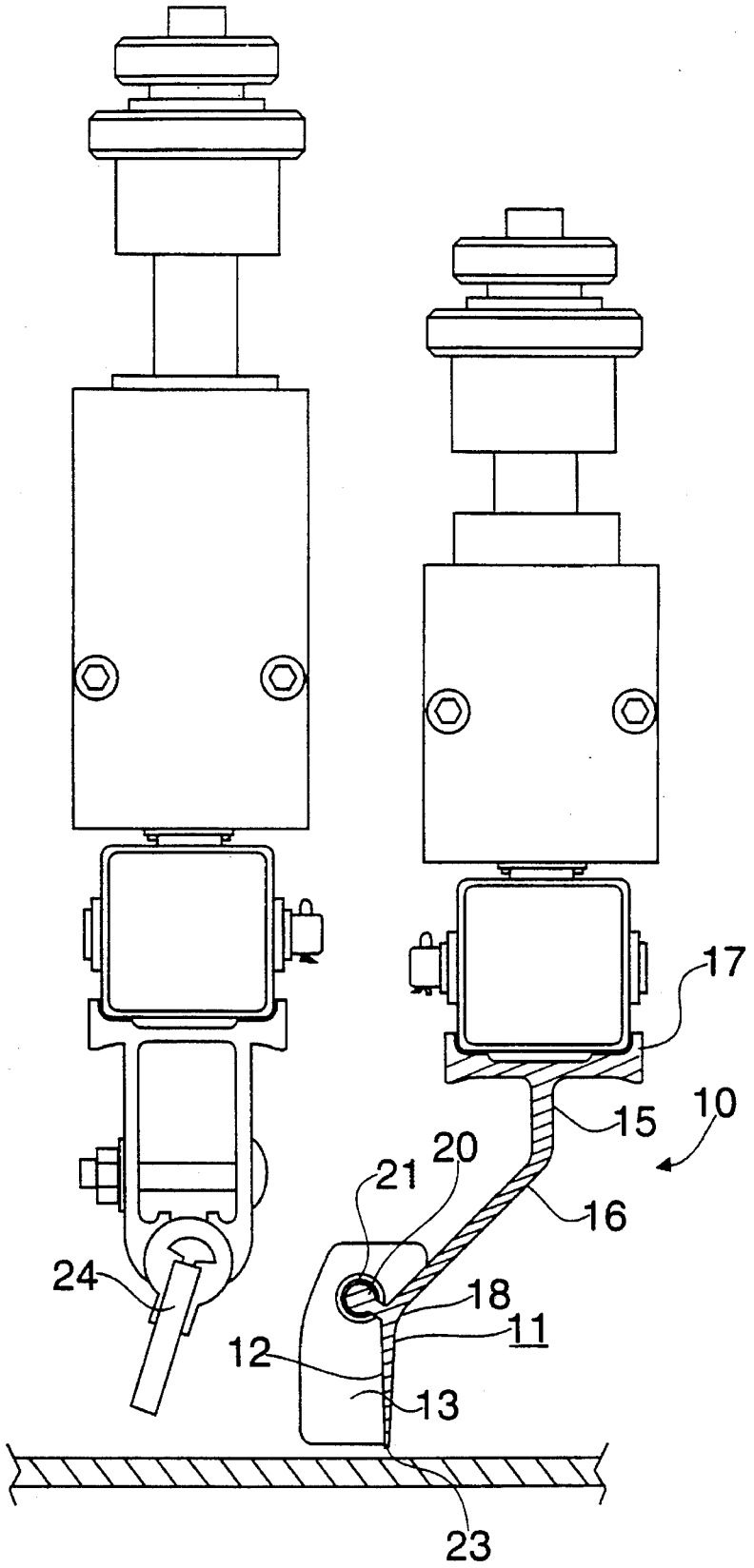
FIG. 3 is a side sectional view of a flood bar and squeegee assembly, in accordance with one aspect of the present invention.
Figure 5:
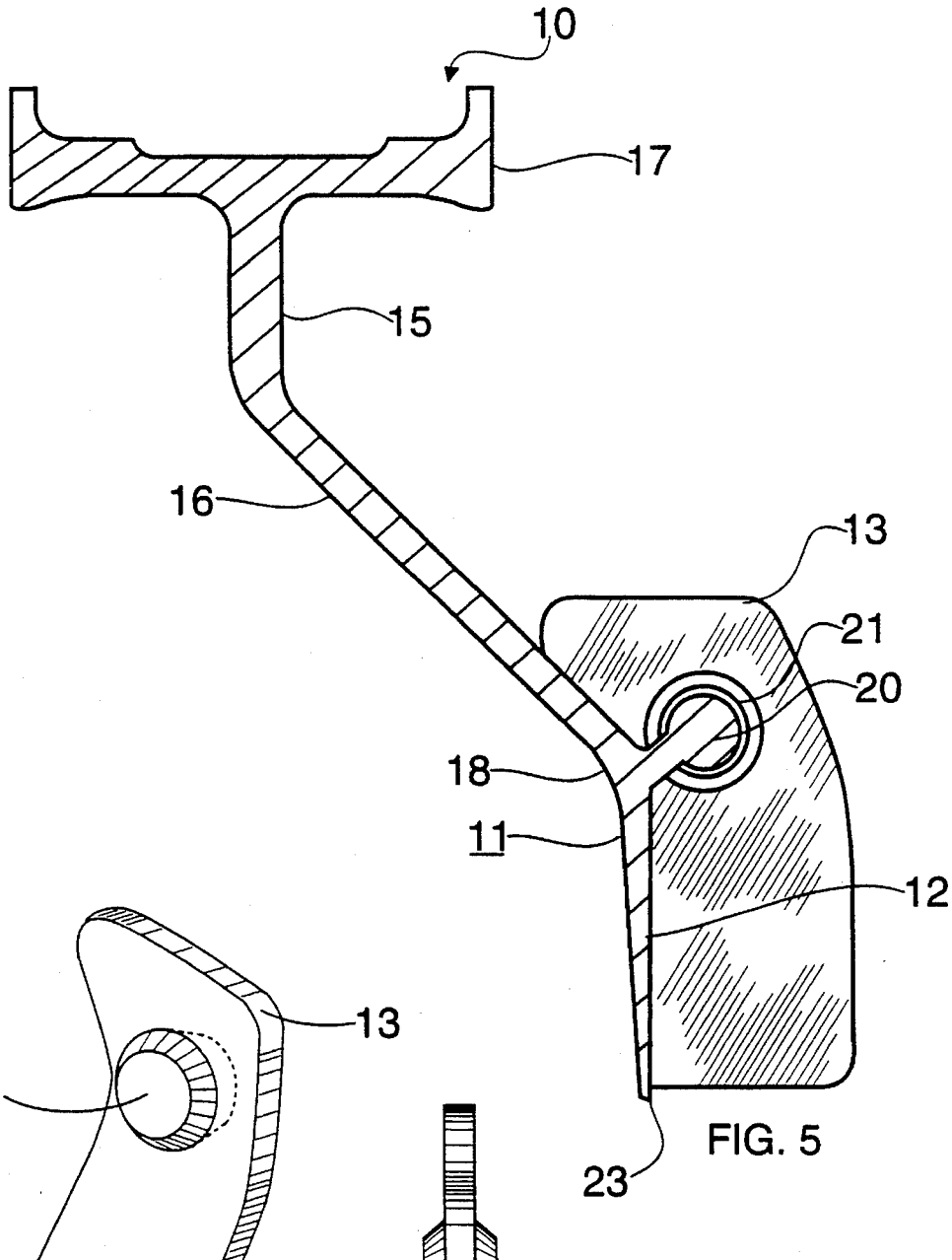
FIG. 5 is an enlarged view of the flood bar of FIG. 3.
Figure 4:
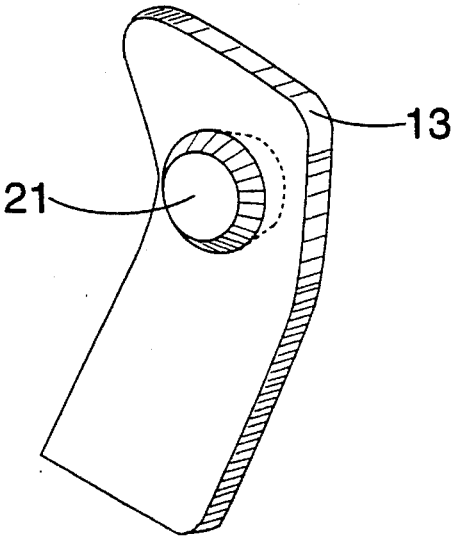
FIG. 4 is a perspective view of a fin of FIG. 1.
Figure 6:
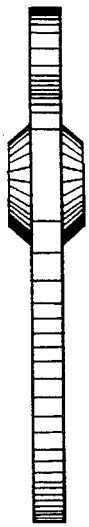
FIG. 6 is an end view of the fin of FIG. 4.

Still other objects and advantages of the present invention will become apparent from the following description of the preferred embodiments.

DETAILED DESCRIPTION OF THE PREFERRED EMBODIMENTS

FIGS. 1–9 illustrate generally a flood bar 10 for printing apparatus, in accordance with various aspects of the present invention. The flood bar comprises an elongated member 11 having an ink engaging face 12. A plurality of spaced apart fins 13 are arranged across the face, the fins being generally parallel to one another and the ends 14*a*, 14*b* of the member being bent inwardly so as to inhibit the flow of ink to the sides of the screen.

The member preferably has a slender body profile, a first portion 15 of which is oriented vertically and a second major portion 16 being an acute angle bend. The second portion is preferably longer than the first, e.g., about twice the length. At the upper end of the structure is a T-shaped mounting member 17 adapted for sliding engagement with operative portions of a printing head (not shown).

At the lower end of the structure (or second portion) is a vertically disposed flood plate 18 extending substantially beyond each end 19*a*, 19*b* of the major portion. The flood plate is bent inwardly at each end, preferably at an acute angle, e.g., about 45°. An objective is to direct printing ink, e.g., a colored plastisol, inwardly as the plate pushes and spreads ink across the printing screen. In an alternative embodiment, the plate ends are bent perpendicular to the plate. In another alternative embodiment, the plate ends are straight and fins are mounted, e.g., by welding, at each plate end, perpendicular to the member.

Figure 7:
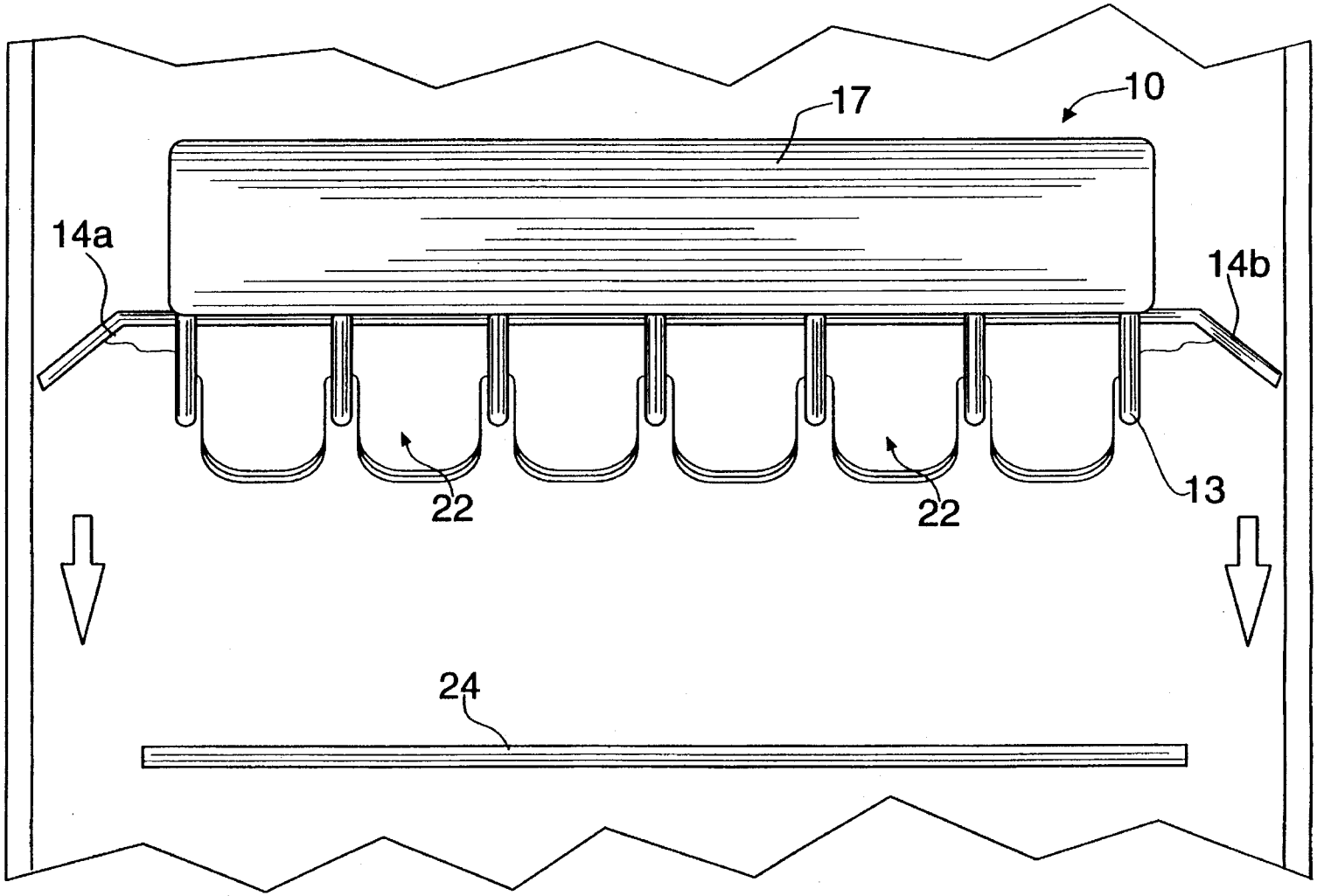
FIG. 7 is a plan view of the assembly of FIG. 3 showing operation of the flood bar.

At the juncture of the flood plate and the second portion is a mounting bar 20. The mounting bar is adapted for sliding engagement with perforation 21 in each of the series of plate-like fins 13. The fins are spaced at intervals across the plate, each pair forming a flow compartment 22 therebetween for pushing an individual (or miniature) ink wave across the screen, as best seen in FIG. 7. It is preferred that the fins be adjustable along the mounting bar to permit variation in the distance between one or more fin pairs. Alternatively, each fin is fixed at a selected or optimum location along the plate.

It will be appreciated by those skilled in the art that the flood bar and its components may be in any shape, configuration or relative proportion, giving consideration to the purpose for which the present invention is intended.

As the flood plate pushes the ink over the screen, lower edge 23 of the plate rides slightly above, e.g., ⅛", 1/16" or 1/32", and preferably not in contact with the screen surface. This allows ink to pass under the plate and fins, and into contact with the screen. It also permits the ink to seep under the fins and travel from compartment to compartment as it flows toward and out of the flood plate ends. This equalizes the flow of ink between compartments and insures that none of the compartments are starved.

Ink, it has been found, has a tendency to flow outwardly when spread across the printing screen. By using the fin and bent (or winged) end arrangement of the present invention, this tendency is slowed or halted, and ink is retained in relatively small compartments formed between each fin pair. This provides more even distribution of ink over the printing surface, and gradual consumption of ink with minimal waste. Larger volumes of ink are also maintained in those regions where ink consumption is greatest. Moreover, by keeping substantially all of the ink in motion, its fluidity is increased. This has been found to increase production and improve the quality of printed images upon each of successive printing operations.

In operation, the flood bar is stroked across the surface of the screen in registry with an article so as to spread (or flood) printing ink evenly over the screen surface.

The miniature wave is formed in the compartment defined by each fin pair as the flood bar pushes the ink across the screen. Next, a print squeegee 24 is stroked back across the screen so as to force the ink through the screen and onto the article, thereby effecting printing. In accordance with one aspect of the present invention, the flood bar and squeegee are in close proximity to one another, e.g., about 2 inches apart. The distance between the fins and the squeegee is considerably less. In an alternative embodiment, the fins extend to within very close proximity of the squeegee for greater flow control.

The embodiment illustrated above involves application of the present invention to multistage printing operations typically used in screen printing composite or multicolored images on articles. A portion and/or color of the image is printed upon each step. However, its application to any printing system, apparatus and/or method is understood, giving consideration to the purpose for which the present invention is intended.

Moreover, while the present invention is shown and described for use in conjunction with sheets of textiles or plastic, its application to other articles such as T-shirts, towels, place mats, pot holders, curtains and sheets will be understood by those skilled in the art, giving consideration to the purpose for which the present invention is intended.

By breaking up or separating the flow into compartments, the present invention advantageously floods the screen with ink upon each pass and helps retain ink between itself and the opposing squeegee. In this manner, the rate and constancy of ink consumption is improved and the ink is dispensed more uniformly. The duration of printing operations without refilling the ink supply is also increased.

The present invention has also been found useful in creating spectral or rainbow-like images. In this connection, printing ink is typically applied in strips or bands generally along the direction of flood bar movement. For example, a first or yellow ink strip is applied to the printing screen, then a second strip of red ink, a third of blue ink and a fourth of green ink. Initially, the strips are separated a selected distance from one another. In accordance with one aspect of the present invention, each strip is aligned with and corresponds to a compartment defined by a pair of fins.

Next, the flood bar pushes the ink across the screen, the fins generally retaining each color within its respective compartment. As the squeegee passes back over the screen, each strip spreads outwardly and meets edge-to-edge with the adjacent strips, the respective colors blending along their meeting edges. For example, the yellow and red strips blend into orange along their adjacent edges, the red and blue strips blend into purple, and the blue and green blend into aqua. The result is a rainbow or prism effect on the printed image.

This is advantageous over conventional flood bars which allow the strips to mix both as the flood bar spreads the ink and during squeegee operation. After a few strokes, rapid discoloration of the strips occurred. The addition of fresh ink was frequently necessary to maintain image quality.

By the present invention, the flow of ink is controlled by fins and mixing occurs primarily during squeegee operation. An automatic ink feeder is preferably used to replenish the supply of printing ink in each compartment. An air blow type ink sensor is also preferred. This allows accurate measurement of ink between the squeegee and flood bar so that the operator or ink feeder is signaled to add more ink at the appropriate time. The volume of ink on the screen surface is controlled by the interplay between the automatic feeding of ink, the ink sensor, and gradual consumption of ink, preventing build-up of ink (or color) well areas on the screen.

Figure 8:
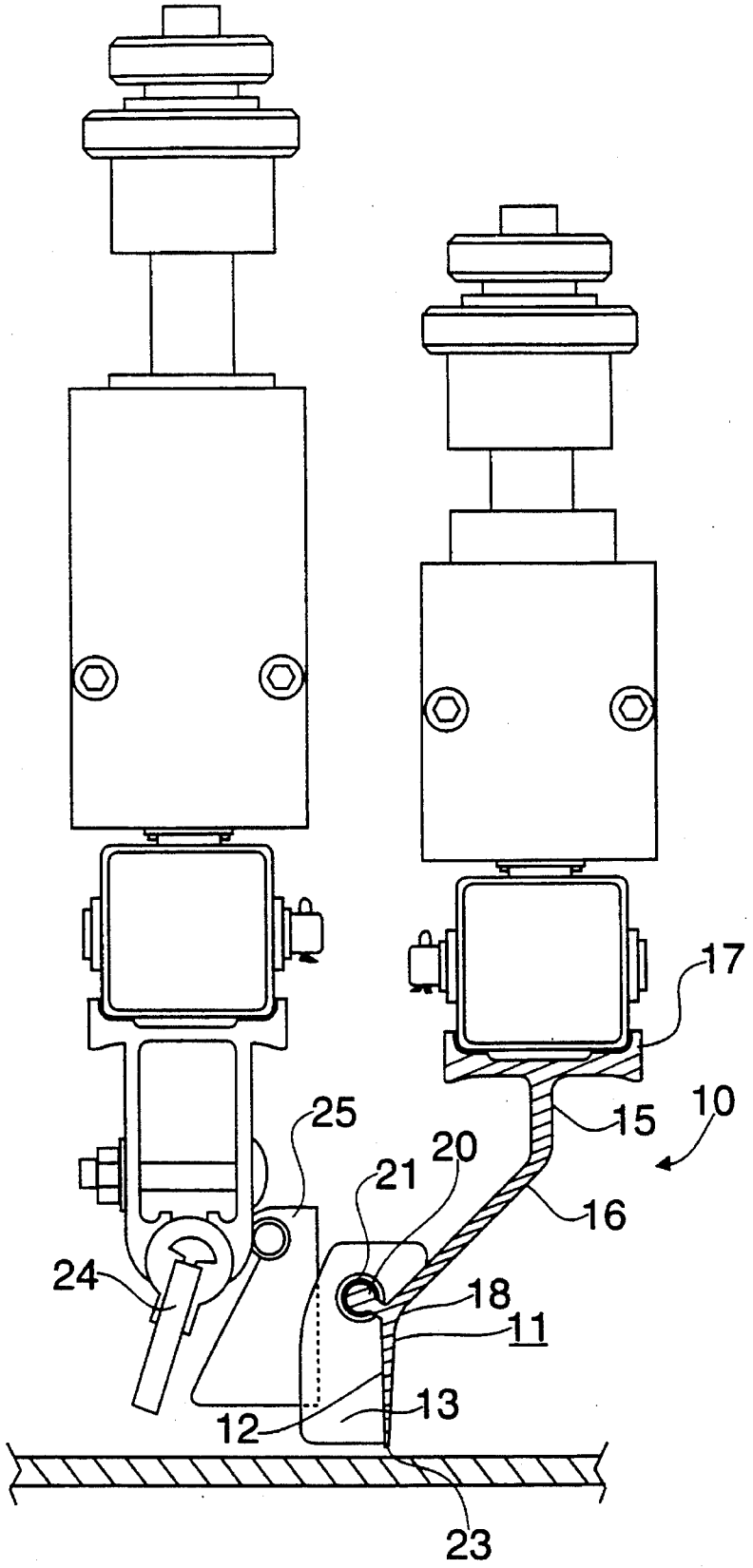
FIG. 8 is a side sectional view of the assembly of FIG. 3, in accordance with another aspect of the present invention.
Figure 9:
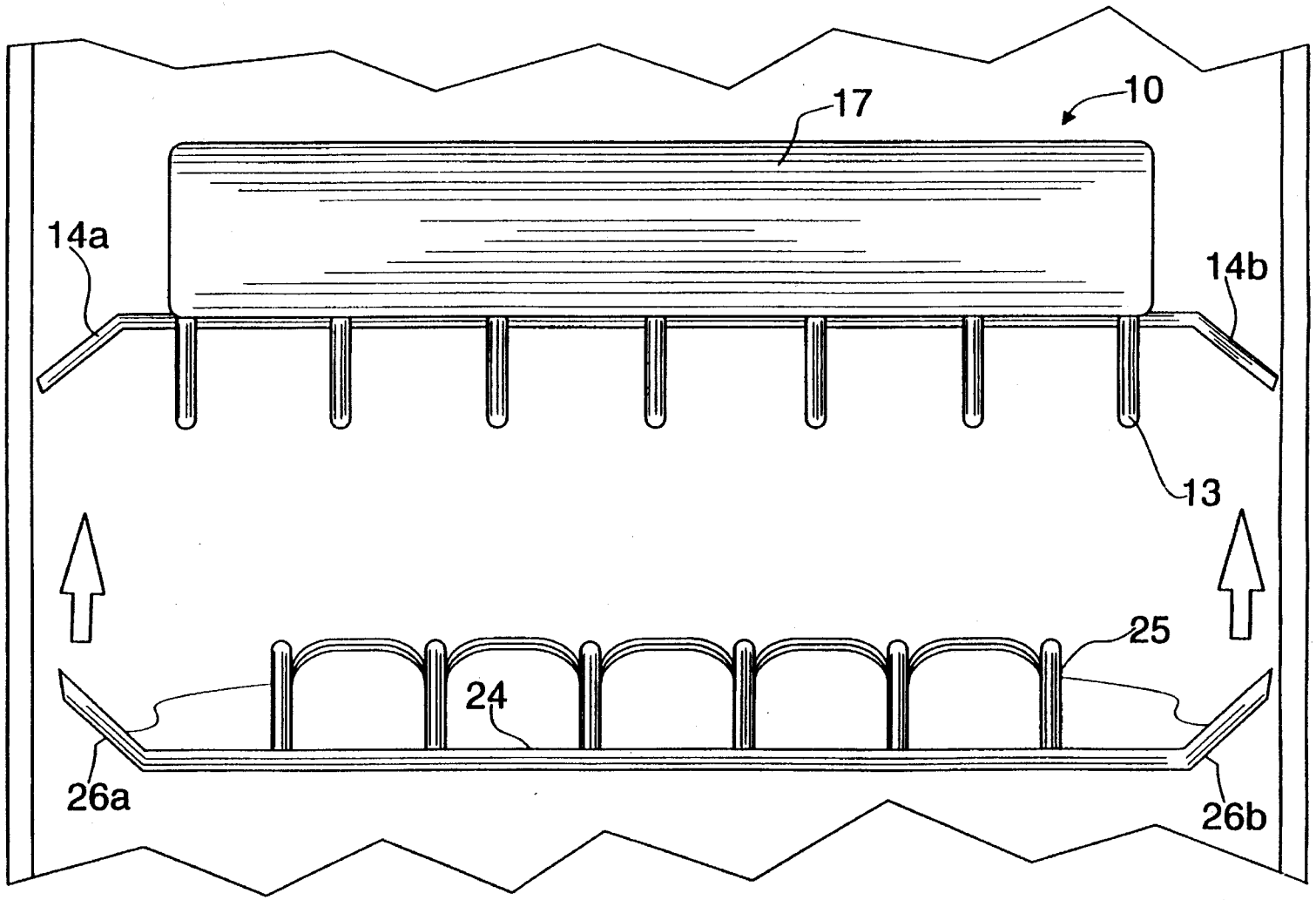
FIG. 9 is a plan view of the assembly of FIG. 8 showing operation of the squeegee.

In another alternative embodiment, as shown in FIGS. 8 and 9, a plurality of fins 25 are similarly located at intervals along the length of the squeegee. Each squeegee fin is preferably parallel to the other squeegee fins, and staggered between and across from a pair of flood bar fins. In this manner, individual flow compartments are formed on the squeegee so that the flow of ink may be controlled both during operation of the flood bar and the squeegee. Alternatively or concurrently therewith, each end 26*a,b* of the squeegee is bent inwardly, e.g., at about a 45° angle, to aid in inhibiting ink flow to the sides of the screen.

Since from the foregoing the construction and advantages of the invention may be readily understood, further explanation is believed unnecessary. However, since numerous modifications will readily occur to those skilled in the art after consideration of the foregoing specification and accompanying drawings, it is not intended that the invention be limited to the exact construction shown and described, but all suitable modifications and equivalents may be resorted to which fall within the scope of the appended claims.

What is claimed is:

1. A squeegee for printing apparatus, which comprises an elongated member having an ink engaging face; and a plurality of spaced apart fins arranged across the face, the fins being generally parallel to one another and each end of the member being bent toward the ink engaging face so as to inhibit the flow of ink to the sides of a screen.

2. A method of controlling the flow of ink over a printing screen, which comprises the steps of providing a squeegee member and, using the member, spreading a plurality of ink waves over a printing screen, the waves being generated by spaced part fins arranged across the face of the member, the fins being generally parallel to one another and each end of the member being bent toward the ink engaging face so as to inhibit the flow of ink to the sides of the screen.

* * * * *